US006827781B1

(12) United States Patent
Hahne et al.

(10) Patent No.: US 6,827,781 B1
(45) Date of Patent: Dec. 7, 2004

(54) DEVICE FOR HUMIDIFYING A MATERIAL WEB

(75) Inventors: Ernst August Hahne, Schweiz (CH); Franz Knopf, Buhl (DE)

(73) Assignee: Eltex-Elektrostatik GmbH, Weil am Rhein (DE)

( * ) Notice: Subject to any disclaimer, the term of this patent is extended or adjusted under 35 U.S.C. 154(b) by 223 days.

(21) Appl. No.: 09/647,896

(22) PCT Filed: Jun. 14, 2000

(86) PCT No.: PCT/EP00/05478

§ 371 (c)(1),
(2), (4) Date: Oct. 6, 2000

(87) PCT Pub. No.: WO01/28693

PCT Pub. Date: Apr. 26, 2001

(30) Foreign Application Priority Data

Oct. 18, 1999 (DE) ..... 199 50 009

(51) Int. Cl.[7] ..... B05B 5/057

(52) U.S. Cl. ..... 118/630; 118/629; 118/627; 118/316; 118/325

(58) Field of Search ..... 118/316, 630, 118/627, 629, 623, 631, 325; 101/488; 427/460, 482, 483

(56) References Cited

U.S. PATENT DOCUMENTS 3,625,743 A * 12/1971 Watanabe ..... 118/630
3,863,108 A * 1/1975 Blythe et al. ..... 361/212
3,930,614 A * 1/1976 Krenkel ..... 239/695
4,826,703 A * 5/1989 Kisler ..... 427/469
5,138,971 A * 8/1992 Nakajima et al. ..... 118/624
5,867,760 A * 2/1999 Mitsuoka et al. ..... 399/313
6,177,141 B1 * 1/2001 Billow et al. ..... 427/420

FOREIGN PATENT DOCUMENTS

DE 72115571 U * 4/1974
DE 7333426 U * 10/1975
FR 1436020 A * 6/1966

* cited by examiner

*Primary Examiner*—Melvin C. Mayes
*Assistant Examiner*—George R. Koch, III
(74) *Attorney, Agent, or Firm*—Antonelli, Terry, Stout & Kraus, LLP

(57) ABSTRACT

A device for moistening a material web moved in the transport direction, is preferably used for re-moistening a paper or textile web dried after printing by means of spray device for spraying a water fog onto the material web under the influence of an electrostatic field produced by a device for electrostatic charging. The device includes a reversing roller provided in the transport direction upstream of the spray device for deflecting the material web. The reversing roller has associated with it a device designed as a corona-charging electrode for electrostatic charging and the spray device has two water spray heads located on both sides of the material web.

26 Claims, 1 Drawing Sheet

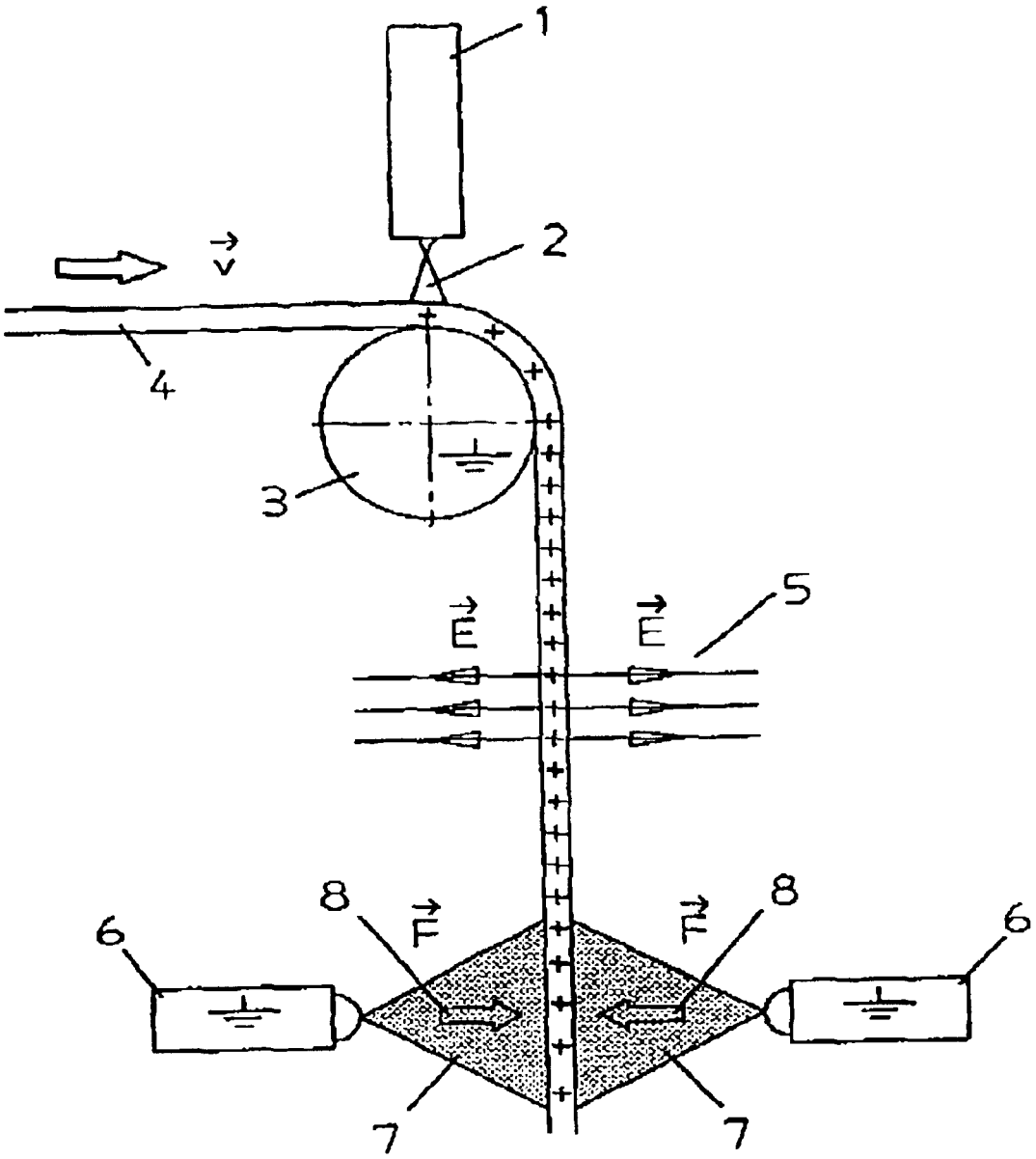
1
2
$\vec{v}$
4
3
5
$\vec{E}$
$\vec{E}$
6
8
$\vec{F}$
$\vec{F}$
8
6
7
7

DEVICE FOR HUMIDIFYING A MATERIAL WEB

This application is a 371 of PCT/EP00/05478, filed Jun. $6^{th}$, 2000, which claims priority to German Application 19950009.6, filed Oct. $18^{th}$, 1999.

BACKGROUND OF THE INVENTION

The invention relates to a device for moistening a material web moved in the transport direction, preferably for re-moistening a paper or textile web dried after printing by means of a spray device for spraying a water mist on the material web under the influence of an electrostatic field generated by an electrostatic charging device.

Devices for re-moistening of this type are known of themselves (EP-0 350 606 A2). They have proven themselves in practice. It is disadvantageous however that these known systems usually are difficult to retrofit in existing systems. Finally, only a moderate degree of re-moistening can be achieved with this known device.

SUMMARY OF THE INVENTION

The goal of the invention is to improve a device for moistening material web moved in a transport direction by means of a spray device for spraying a water fog onto the material web under an influence of an electrostatic field generated by a device for electrostatic charging so that a high degree of moistening can be achieved with small installation sizes.

This goal is achieved by providing a reversing roller for reversing the material web in the transport direction upstream of the spray device, the reversing roller having associated with it a device for electrostatic charging designed as a corona-charging electrode, the spray device having two water spray heads located on both sides of the material web.

It is important for the principle according to the invention that the material web was charged electrostatically in a transport direction before the spraying device (surprisingly more than in the area of the corona electrode in the vicinity outside of the reversing roller) and the material web thus charged influences the sprayed water mist as a result of the electrical field due to the charging, so that the water particles of the spray mist surprisingly are sucked up by the material web, in other words, the water aerosols with opposite charges relative to the paper penetrate the material while astonishingly the applied amount of water (about 2.5 g/$m^2$) has not led to any formation of surface water on the material web. In addition, the moisture profile of the water spray heads has not formed itself on the material web, which may be due to the dominance of the high and uniform distribution of the field strength in the form of a homogeneous field. With this design according to the invention, an efficiency of more than 95% and sometimes even 98% has been reached. In contrast to the known devices, this also has the advantage that significantly less components are required which is directly related to the space requirements of such a device for re-moistening. The latter has the particular advantage of being able to retrofit existing pressure systems simply.

BRIEF DESCRIPTION OF THE DRAWINGS

A preferred embodiment of the invention is explained in greater detail with reference to the drawing and represents a schematic functional diagram with the device according to the invention.

DETAILED DESCRIPTION OF THE PREFERRED EMBODIMENTS

The material web marked 4 as a whole is guided in the transport direction v around a reversing roller represented as a whole by 3 (in the embodiment shown) with a wrap angle of 90°.

As an extension of the diameter passing through the tangent point (in the schematic cross section) the device represented as 1 as a whole is shown to perform electrostatic charging as a corona-charging electrode 1, with the charging direct current being represented by 2 which flows onto the surface of material web 4. It is approximately 2 mA/m. The area of the material web is viewed as a tangent line which touches the jacket of reversing roller 3 in the transport direction.

Reversing roller 3 is a grounded drum which has a smooth, electrically conducting surface which is preferably high-gloss chrome-plated. It has been found that with this design of the charging electrode the material web is charged to its physically maximum field strength so that the electrical field E marked 5 results.

Material web 4 is then guided in the area of two grounded water spray heads 6 located opposite one another on different sides of material web 4. These heads form a spray cone marked schematically as a whole by 7. As a result of the influence, a field strength F marked as a whole by 8 acts on the water aerosols which it forces three-dimensionally into the interior of material web 4.

It is also possible instead of grounding to apply reverse polarity to reversing roller 3 and water spray heads 6. It is also possible for the top side of reversing roller 3 to be coated with polytetrafluoroethylene or risilan to prevent residues of printing ink separating from material web 4 at the surface of the roller.

With this design according to the invention, an efficiency of more than 95% and sometimes even 98% has been reached. In contrast to the known devices, there is also the advantage that definitely fewer components are required which is directly related to the associated space requirements of such a device for re-moistening. The latter has the particular advantage of being able to retrofit existing printing systems in simple fashion.

What is claimed is:

1. Device for moistening a material web moved in a transport direction by means of a spray device for spraying a water fog onto the material web under an influence of an electrostatic field generated between the spray device and an electrostatic charge on a surface of the material web, characterized in that a reversing roller for reversing the material web is provided in the transport direction upstream of the spray device, that the reversing roller has associated with it a device for electrostatic charging designed as a corona-charging electrode, and that the spray device is provided downstream of the reversing roller and comprises two water spray heads located on both sides of the material web, the spray heads being grounded or having a polarity applied thereto opposite that of the corona electrode, wherein an electrostatic field is generated between the electrostatic charge on the material web applied by the corona charging electrode and each spray head on each side of the material web.

2. Device according to claim 1 characterized in that the reversing roller has a smooth surface that is a good electrical conductor.

3. Device according to claim 2 characterized in that the reversing roller is high-gloss chrome-plated.

4. Device according to claim 1 characterized in that the reversing roller has a jacket having a smooth outer surface and a thin coating provided on the smooth outer surface.

5. Device according to claim 4, characterized in that the thin coating is made of polytetrafluoroethylene or risilan.

6. Device according to claim 1 characterized in that the reversing roller is wrapped around by the material web in an angle range that forms at least a right angle.

7. Device according to claim 1 characterized in that the corona-charging electrode is located in a plane spanned by an axis of the reversing roller and a tangent line in an area in which the material web runs onto a jacket of the reversing roller.

8. Device according to claim 1 characterized in that the water spray heads directed at the surface of the material web are grounded.

9. Device according to claim 1 characterized in that the two water spray heads are located opposite one another on the two sides of the material web.

10. Device for moistening a material web moved in a transport direction by means of a spray device for spraying a water fog onto the material web under an influence of an electrostatic field generated between the spray device and an electrostatic charge on a surface of the material web, characterized in that a reversing roller for reversing the material web is provided in the transport direction upstream of the spray device, that the reversing roller is grounded and has associated with it a device for electrostatic charging designed as a corona-charging electrode, and that the spray device is provided downstream of the reversing roller and comprises two water spray heads located on both sides of the material web, the spray heads being grounded or having a polarity applied thereto opposite that of the corona electrode, wherein an electrostatic field is generated between the electrostatic charge on the material web applied by the corona charging electrode and each spray head on each side of the material web.

11. Device for moistening a material web moved in a transport direction by means of a spray device for spraying a water fog onto the material web under an influence of an electrostatic field generated between the spray device and an electrostatic charge on a surface of the material web, characterized in that a reversing roller for reversing the material web is provided in the transport direction upstream of the spray device, that the reversing roller has associated with it a device for electrostatic charging designed as a corona-charging electrode, and that the spray device is provided downstream of the reversing roller and comprises two grounded water spray heads located opposite one another on the two sides of the material web, wherein an electrostatic field is generated between the electrostatic charge on the material web applied by the corona charging electrode and each spray head on each side of the material web, so as to simultaneously spray opposite sides of one portion of the material web at the same time under influence of the electrostatic fields.

12. Device according to claim 11, characterized in that wherein the spray heads spray a free running portion of the web.

13. A device for moistening a material web moved in a transport direction, comprising a reversing roller for changing a transport direction of the material web, a corona-charging electrode for electrostatically charging the material web, the corona-charging electrode being provided on a side of the material web opposite the reversing roller in a vicinity of the reversing roller; and a spray device for spraying water mist onto the material web, the spray device comprising at least one spray head on each side of the material web downstream of the reversing roller, the spray heads being grounded or having a polarity applied thereto opposite that of the corona electrode, wherein an electrostatic field is generated between the electrostatic charge on the material web applied by the corona charging electrode and each spray head on each side of the material web.

14. The device according to claim 13, wherein the spray device is grounded.

15. The device according to claim 13, wherein the spray device has applied to it a polarity opposite that of the corona charging electrode.

16. The device according to claim 13, wherein the corona charging electrode applies a charging current to the material web at a portion of the material web passing through a extension of a diameter of the reversing roller that passes through a tangent point.

17. The device according to claim 13, wherein the reversing roller is grounded.

18. The device according to claim 17, wherein the spray heads are grounded.

19. The device according to claim 13, wherein the reversing roller has applied to it a polarity opposite that of the corona-charging electrode.

20. The device according to claim 19, wherein the spray device has applied to it a polarity opposite that of the corona charging electrode.

21. A device for moistening a material web moved in a transport direction, comprising a reversing roller for changing a transport direction of the material web, a corona-charging electrode for electrostatically charging the material web, the corona-charging electrode being provided on a side of the material web opposite the reversing roller in a vicinity of the reversing roller; and a spray device for spraying water mist onto the material web, the spray device comprising at least one spray head on each side of the material web downstream of the reversing roller, wherein the spray heads are located opposite one another on different sides of the material web, the spray heads being grounded or having a polarity applied thereto opposite that of the corona electrode, wherein an electrostatic field is generated between the electrostatic charge on the material web applied by the corona charging electrode and each spray head on each side of the material web so as to simultaneously spray opposite sides of one portion of the material web at the same time under influence of the electrostatic fields.

22. The device according to claim 21, wherein the spray heads spray a free running portion of the web.

23. The device according to claim 21, wherein the reversing roller is grounded.

24. The device according to claim 23, wherein the spray heads are grounded.

25. The device according to claim 21, wherein the reversing roller has applied to it a polarity opposite that of the corona-charging electrode.

26. The device according to claim 25, wherein the spray device has applied to it a polarity opposite that of the corona charging electrode.

* * * * *